US005149243A

United States Patent [19]

Naab et al.

[11] Patent Number: 5,149,243

[45] Date of Patent: * Sep. 22, 1992

[54] LIFTING/TILTING OR TILTING APPARATUS FOR EMPTYING BINS, IN PARTICULAR GARBAGE BINS, INTO A COLLECTING BIN

[75] Inventors: Jakob Naab, Mainz; Arno Gajewski, Munster-Sarmsheim, both of Fed. Rep. of Germany

[73] Assignee: Zoller-Kipper GmbH, Mainz-Laubenheim, Fed. Rep. of Germany

[ * ] Notice: The portion of the term of this patent subsequent to Jun. 26, 2007 has been disclaimed.

[21] Appl. No.: 461,981

[22] Filed: Jan. 8, 1990

[30] Foreign Application Priority Data

Nov. 21, 1986 [DE] Fed. Rep. of Germany ..... 3639861

[51] Int. Cl.[5] ..... B65F 3/04

[52] U.S. Cl. ..... 414/408; 414/421; 414/743; 414/744.2; 294/68.26

[58] Field of Search ..... 414/743, 408, 406, 407, 414/409, 541, 680, 744.2, 404, 419, 420, 421, 422, 546, 558, 540; 901/45; 294/68.26

[56] References Cited

U.S. PATENT DOCUMENTS

| | | | |
|---|---|---|---|
| 2,611,939 | 9/1952 | Kux | 414/743 X |
| 3,016,157 | 1/1962 | Brisson | 414/408 |
| 3,604,577 | 9/1971 | Hellmeier | 414/421 |
| 3,762,586 | 10/1973 | Updike, Jr. | 414/408 |
| 3,874,534 | 4/1975 | Brisson | 414/406 |
| 4,715,767 | 12/1987 | Edelhoff et al. | 414/408 |
| 4,722,658 | 2/1988 | Wurtz et al. | 414/408 |

FOREIGN PATENT DOCUMENTS

| | | | |
|---|---|---|---|
| 3420058 | 12/1985 | Fed. Rep. of Germany . | |
| 1009926 | 4/1983 | U.S.S.R. | 414/408 |
| 1071533 | 2/1984 | U.S.S.R. | 414/409 |
| 1220959 | 3/1986 | U.S.S.R. | 414/407 |
| 1060612 | 3/1967 | United Kingdom | 414/406 |

*Primary Examiner*—Frank E. Werner
*Attorney, Agent, or Firm*—H. Gibner Lehmann; K. Gibner Lehmann

[57] ABSTRACT

A lifting/tilting or tilting apparatus for emptying bins. The apparatus has a triangular gripping and carrying plate which is connected to a lifting arm by an articulation mechanism and associated reset and blocking device having limited movement. The gripping and carrying plate has a predetermined normal starting position under control of a cam with respect to the lifting arm wherein it is directed with its tip against the bin to be taken up. It can be pivoted to an operating position for dumping. This enables the gripping and carrying plate to avoid impacts when bringing it up to a bin. The limited movability has special significance for the taking up and emptying of large bins, or two smaller bins standing side by side.

7 Claims, 11 Drawing Sheets

LIFTING/TILTING OR TILTING APPARATUS FOR EMPTYING BINS, IN PARTICULAR GARBAGE BINS, INTO A COLLECTING BIN

CROSS REFERENCES TO RELATED APPLICATIONS

The present application claims priority, under 35 USC 119, of West German Application No. P 36 39 861.6 filed Nov. 21, 1986, and claims priority under 35 USC 120 of, and is a continuation-in-part of our copending U.S. application Ser. No. 07/121,622 filed Nov. 17, 1987, now U.S. Pat. No. 4,936,732 dated Jun. 26, 1990.

BACKGROUND OF THE INVENTION

1. Field of the Invention

This invention relates to a lifting/tilting or tilting apparatus for emptying bins into the opening of a collecting bin, in particular for emptying garbage bins into the collecting bin of a garbage vehicle. Such an apparatus commonly comprises a substantially triangular gripping and carrying plate which cooperates with an uptake pocket or recess provided in the edge region of the bin to be emptied and which is arranged, with its tip pointing upward, at the free end of a lifting arm that is able to be extended and/or pivoted out. The upper triangular sides of the gripping and carrying plate form gripping surfaces that slope down toward the side wall located away from the bin to be picked up.

2. Description of the Related Art Including Information

Disclosed Under 37 CFR §§1.97-1.99

In a device of this kind as known from the Federal Republic of Germany Printed Application No. 34 20 058, the substantially triangular gripping and carrying plate is arranged on a gripper arm for limited pivoting about its vertical center axis, and in consequence of the limited lowering of the gripping and carrying plate, said plate is thus pivoted under the load of the bin being picked up, by means of a cam arrangement, about said vertical center axis into a normal position and is retained therein. However, for many practical purposes this limited pivotability of the gripping and carrying plate about the vertical axis has proved insufficient for taking up any bins which are held in readiness for dumping when in a more or less slanting position.

SUMMARY OF THE INVENTION

It is, therefore, an object of the present invention to improve the lifting/tilting or tilting device of the above, initially addressed kind in the sense that by means of an additional adjustability of the gripping and carrying plate, its grip on those bins which are held in readiness for dumping in a more or less slanting position is facilitated, and the gripping and transfer of the respective bins into a normal starting position for dumping are made safer.

To solve this problem the invention provides that the gripping and carrying plate is connected for limited mobility with respect to the lifting arm through joint devices, and for each joint device contained in the connection between the lifting arm and the gripping and carrying plate a setting means is provided to maintain the gripping and carrying plate in a normal starting position relative to the lifting arm, as established for the dumping process.

By the invention, such device joints can be provided adjacent to the gripping and carrying plate or else directly on the gripping and carrying plate, in order that such plate will, when brought close to a bin to be taken up, adapt itself to the bin position as much as possible and thereafter move the bin into the normal starting position established for the dumping process, after the bin is initially taken up.

According to a basic possibility for accomplishing this, the lifting arm can comprise, as an articulated connection with the gripping and carrying plate, a bracket having limited rotation in the starting position about a vertical axis. Thereby a limited pivoting movement about a substantially vertical axis is made possible for the gripping and carrying plate. This possibility of a limited pivoting movement about a vertical axis, by itself alone, offers safe uptake of bins that are set up obliquely, and safe transfer of the gripping and carrying plate with the received bin into the normal starting position for dumping.

Building on this basic possibility, there can be applied on the said bracket a horizontally arranged cross-support, on which at least one gripping and carrying plate is provided, laterally spaced from the axis of rotation of the bracket. Thereby the gripping and carrying plate is given the additional possibility of a limited translatory movement, further facilitating the safe uptake and lifting of obliquely set bins. This measure can preferably be further developed and improved by constituting the cross-support relative to the axis of rotation of the bracket in the manner of a two-armed lever, with a gripping and carrying plate on each of its lever arms. The two-armed lever type cross-support forms, together with the two gripping and carrying plates, a kind of lever system which is equally suitable for emptying relatively large bins, equipped with two takeup pockets, and for the simultaneous takeup and emptying of two smaller bins standing ready for dumping side by side. When the cross-support is brought up to one larger bin, the cross-support with the two gripping and carrying plates adjusts itself to any slanting position of the larger bin. When it is brought up to two bins to be emptied, the lever system formed by the cross-support with the gripping and carrying plates adjusts itself to the given mutual position of the two bins, in that the plate striking against the respective bin first causes, upon further advance of the equipment, a pivoting of the cross-support at the bracket, until also the second gripping and carrying plate has made contact on the second bin. The final leading in and taking up or raising of the bins is then achieved by the shape of the gripping and carrying plates, and this both for one larger bin with two takeup pockets as well as for two smaller bins with one takeup pocket.

Bringing the bracket and possibly the cross-support back into the normal starting position established for the dumping process can be greatly improved and facilitated in that the limitedly rotatable bracket contains a reset means, by which the bracket can be secured against turning in its central position of turning.

For the formation of such a reset means there may be provided, for example, in addition to the limitedly rotatable bracket at least one return spring which is active between the gripping and carrying plate and the lifting arm and is constructed for example as a spring rod or as an extension spring. Such spring rod provides for resetting the gripping and carrying plate to its central position which determines the normal starting position for dumping. Alternatively, the limitedly rotatable bracket itself can contain at least one torsion spring for resetting it to its central position of rotation which determines the normal starting position of the gripping and carrying plate established for the dumping process.

The blocking of the gripping and carrying plate in its normal starting position for dumping can take place due to the fact that the reset unit comprises an engaging device which operates counter to the force of a support spring and by the load of a received bin. Alternatively, the blocking can occur together with the transfer of the lifting arm into its normal starting position for dumping, when the lifting arm is being folded into this normal starting position. To this end the lifting arm may be mounted on a pivot arm that is foldable into a normal starting position for dumping. A control element can be inserted between the lifting arm and the pivot arm, to respond to the folded position of the lifting arm relative to the pivot arm. For example, such element can be a hydraulic piston/cylinder, and the reset unit of the bracket can comprise an engaging device which by means of the control element is actuable in a sense such that with the lifting arm folded into normal starting position, the resetting device blocks the bracket in its central position of rotation. The reset unit and the engaging device can be matched in such a way that the mobility in the bracket is increasingly reduced with the folding of the lifting arm, namely between a greatest mobility with the lifting arm flapped outward and a complete fixation with the lifting arm flapped in. Another possibility for the reset unit and blocking unit without the need for an engaging device consists, according to the invention, to constitute the reset unit as a hydraulic setting and blocking cylinder engaging the bracket through a lever and carried on the apparatus frame so as to pivot about a vertical axis. The cylinder is connected to the hydraulic control and operating system for the pressure medium motors of the lifting and tilting apparatus. The hydraulic setting and blocking cylinder can contain a differential control piston continuously pressurized on both its sides by the hydraulic pressure medium of the control and operating system for the pressure medium motors. That end position of the piston which is associated with the larger piston surface, establishes the normal starting position of the gripping and carrying plate relative to the lifting arm.

The invention provides also a second basic possibility for the articulated attachment of the gripping and carrying plate to the lifting arm, in the sense that there is mounted on the lifting arm a substantially horizontal cross-support for the gripping and carrying plate, and said plate is movably connected with the cross-support on the one hand through at least one articulated lever and reset spring and, on the other hand, is guided by means of at least one cam mechanism for simultaneous vertical displacement and pivoting in and out with respect to the cross-support.

According to this second possibility, the functional cooperation between the articulated lever having the return spring and the cam mechanism of the gripping and carrying plate brings about an additional adjusting movement by which the tip of the triangular shape of the plate can incline toward the bin to be emptied. In its position inclined toward the bin to be emptied, the triangular tip of the gripping and carrying plate is able to become engaged at practically any point of the uptake pocket provided in the bin. Even when the triangular tip of said plate is applied only at one or the other outer end of the uptake pocket provided in the bin to be emptied, close to the opening thereof, a slight raising of the lifting/tilting device will suffice to let the bin slide safely with its uptake pocket into a defined position over and onto the gripping and carrying plate. As the load is being transferred from the bin to be emptied to the gripping and carrying plate by raising movement of the lifting arm, the plate due to its movable application and its cam conduction at the cross-support is brought into the defined operating position for the emptying of the bin.

This second basic possibility can be employed in conjunction or in combination with the above explained first basic possibility, so that there results in practice a universal mobility of the gripping and carrying plate with respect to the lifting arm, yet the safe transfer of the bin to be emptied into the normal starting position for dumping is ensured.

As a preferred form of realization of this second basic solution, mutual matching of the hinge lever, return spring and cam are provided, in such a way that the return spring holds the gripping and carrying plate, in the unloaded state thereof relative to the cross-support, in a raised position inclined toward the bin to be received and emptied. Under a downwardly directed force exerted on the gripping and carrying plate the matching permits a lowering and simultaneous pivoting of the gripping and carrying plate relative to the cross-support as the spring force is being overcome. The cam mechanism enables the gripping and carrying plate to swing toward the cross-support, even without vertical lowering, when the gripping and carrying plate, on being brought close, comes in contact with the bin wall and bears against it areawise in being pivoted inward more or less. This applying of the gripping and carrying plate against the bin wall takes place without any appreciable exertion of force, so that the plate lays itself gently against the bin to be emptied, without danger of pushing the bin away or knocking it over when gripping it.

In this second basic solution, the cam mechanism can contain a wedge or fork-shaped cam carried by the cross-support, and a cam sensing roller carried by the gripping and carrying plate. In each case, however, the parts of the cam mechanism are to be matched so that with the gripping and carrying plate lowered all the way, a safe forceful closure is ensured for the transmission of the load of the received bin onto the cross-support, and a fixed defined position or location of the gripping and carrying plate is ensured at the cross-support. With a forked design of the cam this can be achieved, for example, by forming the cam with a wedge-shaped guiding finger and a limiting finger, the distance between the two fingers diminishing downwardly and terminating in a limiting trough at the lower end. If the cam is wedge-shaped, analogously a lower guideway limitation for the cam gripping roller may be provided so as to form there the forceful closure required for load transmission to the cross-support. In both cases, there may be associated with the cam preferably an aligning edge as a bearing surface for the aligning of the gripping and carrying plate in its lowest position vertically or with a predetermined angle of inclination, so as to assure in this manner a defined normal starting position for the actual dumping process. With this aligning edge, together with the lower movement limitation of the cam sensing roller, a kind of wedging engagement can be formed, which constitutes an additional improvement for the forceful closure between the gripping and carrying plate and the cross-support.

To secure the gripping and carrying plate in the normal starting position for the actual dumping process and also against lateral tilting or displacement, the cam sensing roller can be mounted on two strips or sheet metal plates secured in spaced relation to each other, on the gripping and carrying plate. The distance between the two strips or plates forms an uptake and guiding space for the cam. For an especially advantageous operating movement of the gripping and carrying plate during its lowering and lifting as well as its pivoting in and out, the return spring is constituted as an extension spring whose line of action if offset relative to the cross-support and is spaced from the fulcrums of the articulated lever in any position of the gripping and carrying plate.

In both basic possibilities of the invention the gripping surfaces of the gripping and carrying plate have a gripping edge, form a convex arch and make an acute angle with respect to a substantially flat abutment surface provided for the bin to be lifted, on that side of the gripping and carrying plate which faces the bin. This especially advantageous form of gripping and carrying plate permits a safe, smooth introduction of the triangular gripping part thereof into the uptake pocket provided in the bin to be emptied. Further, by the invention, a safe load transmission from the bin to the gripping and carrying plate can be improved when lateral continuations of its gripping surfaces, at each of its two sides, are constituted as substantially ear-shaped lateral support elements with upper bearing surfaces for the walls of the uptake pocket provided in the bin. These additional substantially ear-shaped lateral support elements ensure a uniform load transmission from the gripped bin to the gripping and carrying plate, so that the latter in turn provide for a uniform load transmission to the upwardly moving lifting arm or to the cross-support, whether directly or indirectly via articulated levers and return spring and cam arrangement.

Other objects of the invention include the provision of an improved bin gripping and lifting mechanism which is especially simple in its construction, low in cost, and rugged and reliable in operation.

Other features and advantages will hereinafter appear.

BRIEF DESCRIPTION OF THE DRAWINGS

Embodiment examples of the invention will be explained more specifically in the following with reference to the drawing, in which.

DESCRIPTION OF THE PREFERRED EMBODIMENT

Figure 1:
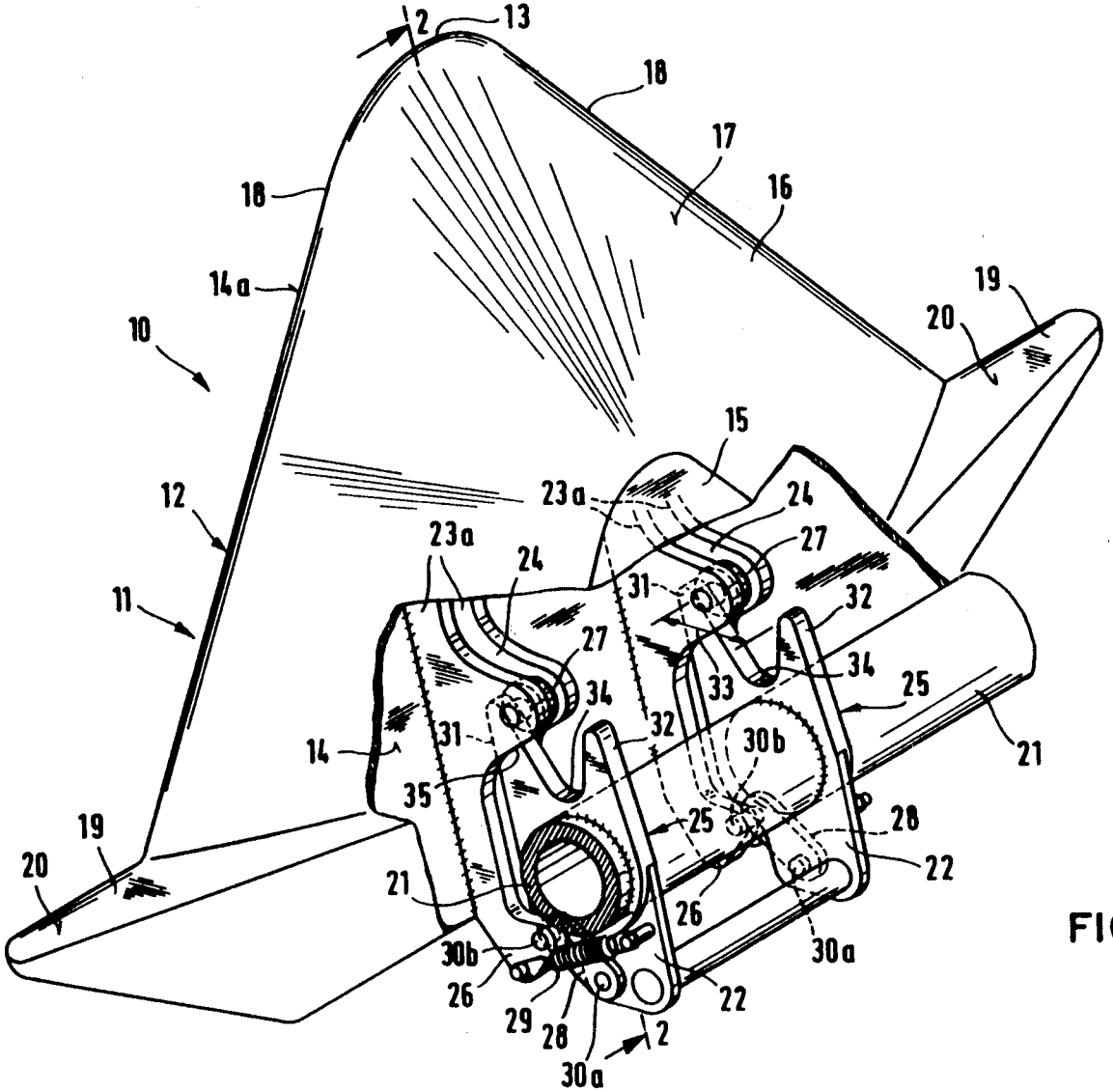
FIG. 1 shows a takeup claw of a lifting/tilting or tilting device according to the invention, in perspective representation and partly broken open.

In the illustrated examples, the takeup claw 11 of the takeup device 10 is provided with a gripping and carrying plate 12 which is of substantially triangular shape with an upwardly directed, rounded triangular tip 13. The gripping and carrying plate 12 is hollow and comprises a substantially flat abutment wall 14 adapted to be set opposite the bin 55 which is to be received and lifted, a back wall 15 disposed away from the bin 55, and a gripping wall 16 connecting the abutment wall 14 and the back wall 15 at their upper edges and covering the gripping and carrying plate 12. The gripping wall 16 is formed on its exterior with a convexly arched gripping surface 17 which, with the formation of a gripping edge 18, is connected at an acute angle to the flat surface of the abutment wall 14. On both sides of the triangular base of the gripping and carrying plate 12 ear-shaped lateral support elements 19 are connected and have upper bearing surfaces 20 for engagement with the wall of an uptake pocket for plate 12 which is provided in the bin to be received and lifted.

Figure 2:
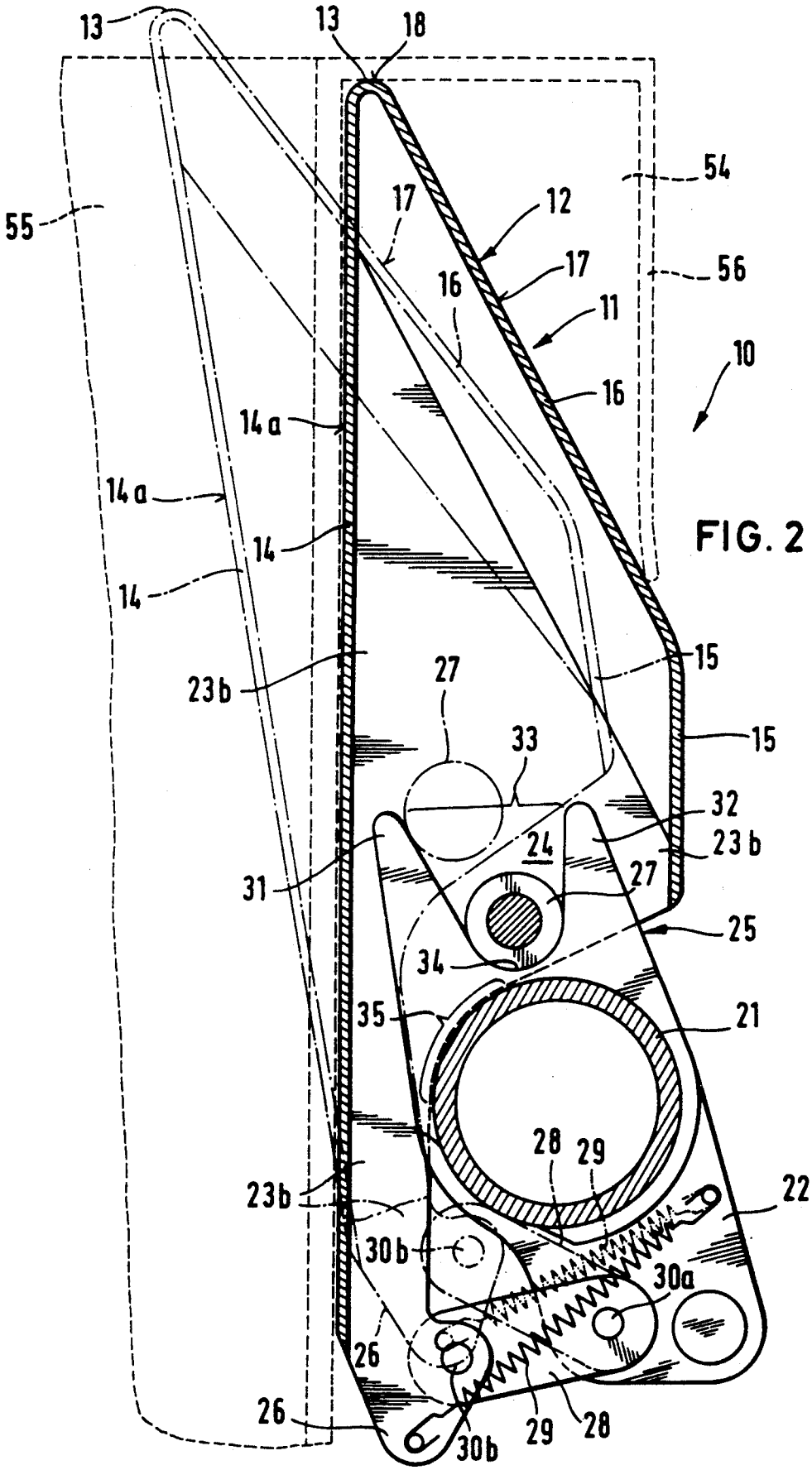
FIG. 2 is a section through a takeup claw according to FIG. 1, along the line 2—2 of FIG. 1.

In the illustrated examples, the takeup claw 11 is equipped with means for lowering of and simultaneous pivoting of the gripping and carrying plate 12 toward and away from a cross-support 21 of the take-up device. As can be seen in FIG. 2, the pivoting of the gripping and carrying plate 12 with respect to the cross-support 21, is about a horizontal axis which is not stationary but which instead shifts in an upward or downward direction as pivoting movement of the gripping and carrying plate 12 occurs. To this end, two mutually spaced bearing plates 22 are fixed on the underside of the cross-support 21, while in the interior of the gripping and carrying plate 12 reinforcement strips **23*a* (FIG. 1) or reinforcement walls 23*b* (FIG. 2) are firmly mounted in pairs spaced from each other, each pair of such reinforcement strips 23*a* or reinforcement walls 23*b* forming by their mutual distance or separation an uptake and guiding space 24 for a cam piece or mechanism 25 secured on the cross-support 21 above the bearing plate 22. At their lower ends, the reinforcement strips 23*a* or reinforcement walls 23*b* have projections 26, while in their central regions sensing rollers 27 cooperating with the respective cams 25 are rotatably mounted. Extending between the bearing plates 22 fixed on the cross-support 21 and the projections 26 of the reinforcement strips 23***a* or reinforcement walls 23*b* are articulated levers 28, which are pivotably mounted both at the bearing plates 22 and at the projections 26 in fulcrums 30*a* and 30*b*. Further there extends at least between one projection 26 and one bearing plate 22 a return spring 29, which in the illustrated example is a helical extension spring. The way in which this return spring 29 is applied is such that in any position of the gripping and carrying plate 12 its line of action is offset from and spaced from the fulcrums 30*a* and 30*b* of the articulated levers 28, and by the provision of such articulated levers 28 and the provision of the return spring 29, the gripping and carrying plate 12 is resiliently and yieldably held, in the unloaded state, in a position raised with relation to the cross-support 21, as can be seen especially clearly from the broken-line showing in FIG. 2. The upper end position can be defined by contact of at least one articulated lever 28 with the cross-support 21.

In the illustrated example, the cam 25 is of forked design with a wedge-shaped guiding finger 31 and a limiting finger 32. The distance 33 between the guiding finger 31 and the limiting finger 32 diminishes downwardly and ends in a limiting trough 34. The cam sensing roller 27 runs on the cam edge of the guiding finger 31, which faces the limiting finger 32, down into the limiting trough 34. The lowest position of the gripping and carrying plate 12 is defined by the position of the cam sensing roller 27 in the limiting trough 34.

Between the suspension of the cam sensing roller 27 and the lower projection 26, the reinforcement strips 23*a* or reinforcement walls 23*b* are provided with an aligning edge 35 which in the lowest position of the gripping and carrying plate 12 places itself against the cross-support 21 next to the cam 25 and thereby fixes the gripping and carrying plate 12 in its lowest position against any pivoting or tilting movement. In every position above this lowest position, the gripping and carrying plate 12 is held with its cam sensing rollers 27 abutting on the guiding edges of the guiding finger 31. This means that above this lowest position the gripping and carrying plate 12 has a freedom of movement corresponding to the width of the distance 33 between the finger 31 and the finger 32 for backward tilting or backward pivoting which is counter to the force of the return spring 29.

As is evident especially from FIG. 2, the guiding finger 31 with its guiding edge is arranged so that the gripping and carrying plate 12 in its uppermost position is inclined with its abutment wall 14 or abutment surface 14*a* toward a bin to be received, while in the bottommost position a substantially vertical arrangement of the abutment wall 14 or abutment surface 14*a* is provided. Alternatively there could be provided a slanting position of the abutment surface 14*a* corresponding to the slant of the bin wall and going beyond the vertical in the lowest position of the gripping and carrying plate 12.

As the plate 12 is being moved toward a bin to be taken up, the tip 13 gets under the opening of an uptake pocket for the gripping and carrying plate 12 provided in the bin. If this leads to contact between the tip 13 and the bin wall, the gripping and carrying plate can flex in a sense counter to the force of the return spring 29, without displacing or knocking over a bin placed in readiness, namely in a pivot or tilt range which is determined by the relatively large distance 33 existing between the upper parts of the guiding finger 31 and limiting finger 32.

With the lifting or raising movement of the lifting arm 37 of the takeup device 10 for the purpose of taking up the bin to be emptied, the gripping and carrying plate 12 slides with its tip 13 into the uptake pocket provided for this purpose in the bin, and it can be useful for the introduction of the gripping and carrying plate 12 into the uptake pocket of the bin, if the upper end portion of the abutment surface 14*a* of plate 12 is formed, at least in the vicinity of the tip 13, in the manner of a rounded gripping edge 18, which facilitates the entry of plate 12 into the opening of the uptake pocket at the bin. The aperture edge of the pocket at the bin then slides over the concave gripping or lifting surface 17 of the plate 12 until the lower edges of wall portions of the pocket set down on the concave surface 17, with one or the other of the bearing surfaces 20 at the ear-shaped lateral support elements 19 being able to come in contact with wall portions of the uptake pocket at the bin, to prevent excessive slanting of the picked-up bin. With the further lifting of the takeup device 10 the bin to be emptied is then lifted off the ground, and the weight of the bin is transmitted as a load to the gripping and carrying plate 12 and possible in part also to the ear-shaped lateral support elements 19 thereof. Under the action of this load, the articulated levers 28 pivot downward, counter to the force of the return spring 29, and the sensing rollers 27 run along the guiding edges of the cam 25 or respectively the guiding fingers 31 until the cam sensing rollers 27 run into the limiting trough 34 and the plate 12 gets into its lower position, fixed relative to the cross-support.

With the lowering of the takeup device 10 having an emptied bin, after the bin has been initially set down on the ground, the gripping and carrying plate moves upward under the force of the return spring 29 relative to the cross-support 21, being retained however in its position within the uptake pocket of the bin. When the gripping and carrying plate 12 has reached its topmost position relative to the cross-support 21, and with the further lowering of the takeup device 10 there occurs the extraction of plate 12 from the uptake pocket of the bin. The gripping and carrying plate 12 with its abutment surface 14*a* can be guided along the wall of the bin, and its vertical position or inclination relative to the cross-support 21 as established in the topmost position can substantially be maintained. The gripping and carrying plate 12 having been pulled downwardly and out from the uptake pocket on the bin, the emptied bin can then be removed or the takeup device 10 can be retracted from the emptied bin. In either case the abutment surface 14*a* of plate 12 is then released from the bin wall, and under the action of the return spring 29 the gripping and carrying plate 12 pivots or tilts back into the starting position which is inclined toward a bin to be emptied.

Figure 3:
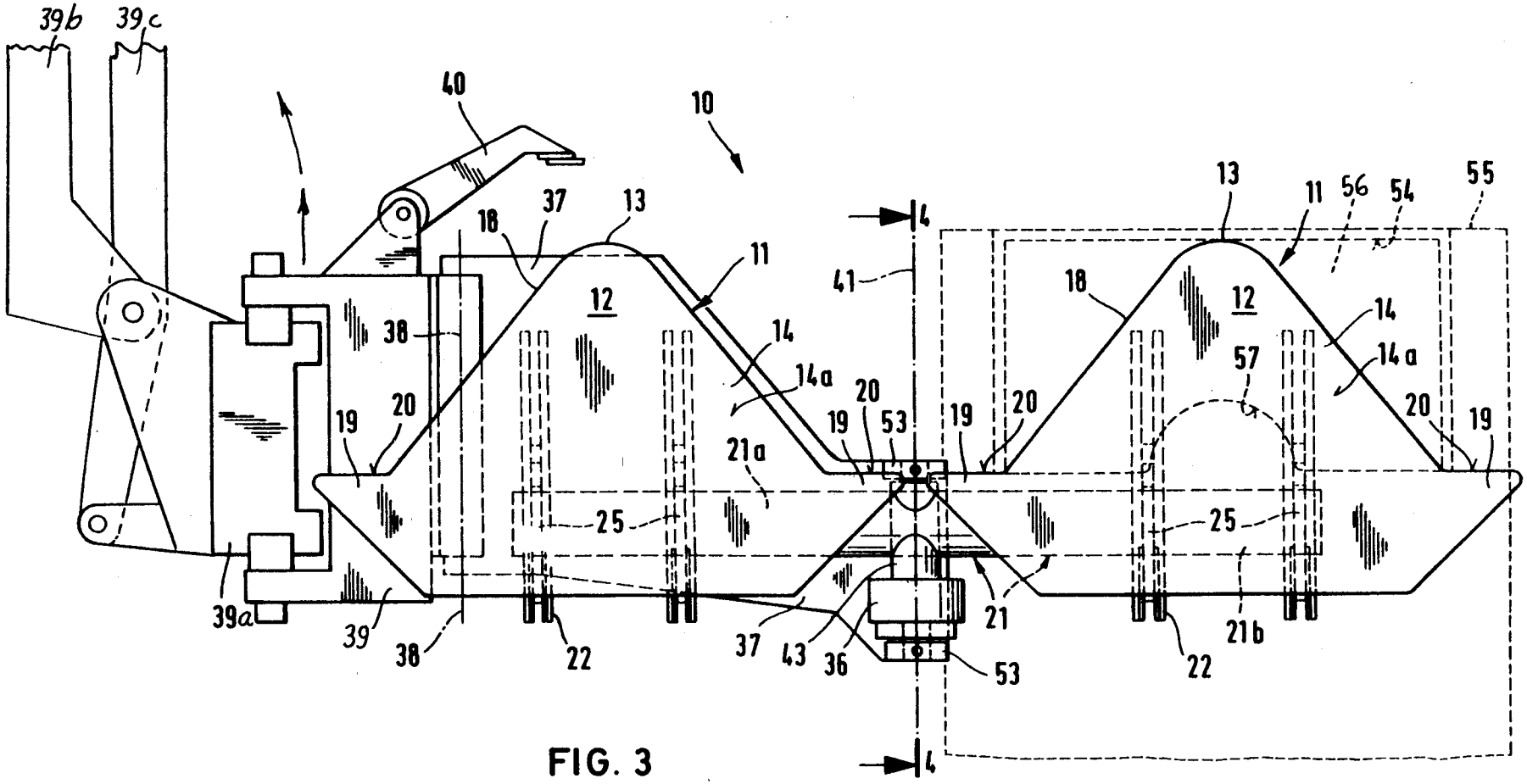
FIG. 3 is a rear elevational view of a takeup device equipped with a pair of takeup claws, as utilized in the lifting/tilting device of the invention.

FIG. 3 shows a construction of takeup device 10 with two gripping and carrying plates 12 disposed on a cross-support or cross beam 21. In its center, between the two gripping and carrying plates 12, the cross-support 21 is connected through a limitedly rotatable bracket or pivot joint 36 with a lifting arm 37 which is pivotally mounted on a pivot arm 39 carried by a slide bar 39*a*. Further, the lifting arm 37 is pivotable with respect to the pivot arm 39 about an axis 38, which is vertical in the starting position. The slide bar 39*a* and lifting arm 37 together can have up and down movements as indicated by the arrows above the bar 39*a* in FIG. 3, being lifted and tilted by pivotally-connected operating members 39*b* and 39*c* whose upper ends extend to conventional powered drive mechanisms, not shown, which are preferably pneumatically operated in a known manner in bin-lifting and tilting devices of the type under consideration. The member 39*b* functions as a lifting member, whereas the member 39*c* functions as a steering member. By this arrangement, the lifting arm 37 can have up and down movement, under the action of the operating members 39*b* and 39*c*, and can also have pivotal movement, under the action of the arms 39*b* and 39*c*, about a horizontal axis in FIG. 3, said horizontal axis being perpendicular to the plane of the paper and coinciding with the common pivot axis of the operating members 39*b* and 39*c* and the slide bar 39*a*. A positively controlled locking device 40 mounted on the pivot arm 39 is provided, for selective engagement with the received bin or bins to be emptied.

As can be seen from FIG. 3, the cross-support 21 with the bracket 36 forms a system in the manner of a two-armed lever, the arms 21*a* and 21*b* of which are adapted for limited forward and backward pivoting, in the starting position, about the vertical axis of rotation 41 (FIG. 3) of the bracket 36. The takeup device 10 according to FIG. 3, equipped with a pair of gripping and carrying plates 12, is suitable either for the takeup of large bins with two take-up pockets arranged side by side, or for the takeup of two smaller bins with one take-up pocket each. The ability of the cross-support 21 to pivot about the axis 41 of bracket 36 offers the possibility also to compensate a limited angular amount as the takeup device is backed toward an obliquely set large bin, or to compensate for limited differences in the standing (separating) distance between bins set up side by side and which are to be taken up simultaneously. In other respects, the takeup device 10 of FIG. 3 for each of the two gripping and carrying plates 12 can each be equipped with the means, explained above in connection with FIG. 1 and FIG. 2, for a lowering and a pivoting relative to the cross-support 21, and the movement of one gripping and carrying plate 12 with respect to the cross-support 21 is independent of the movement of the other gripping and carrying plate, and vice-versa.

Figure 10:
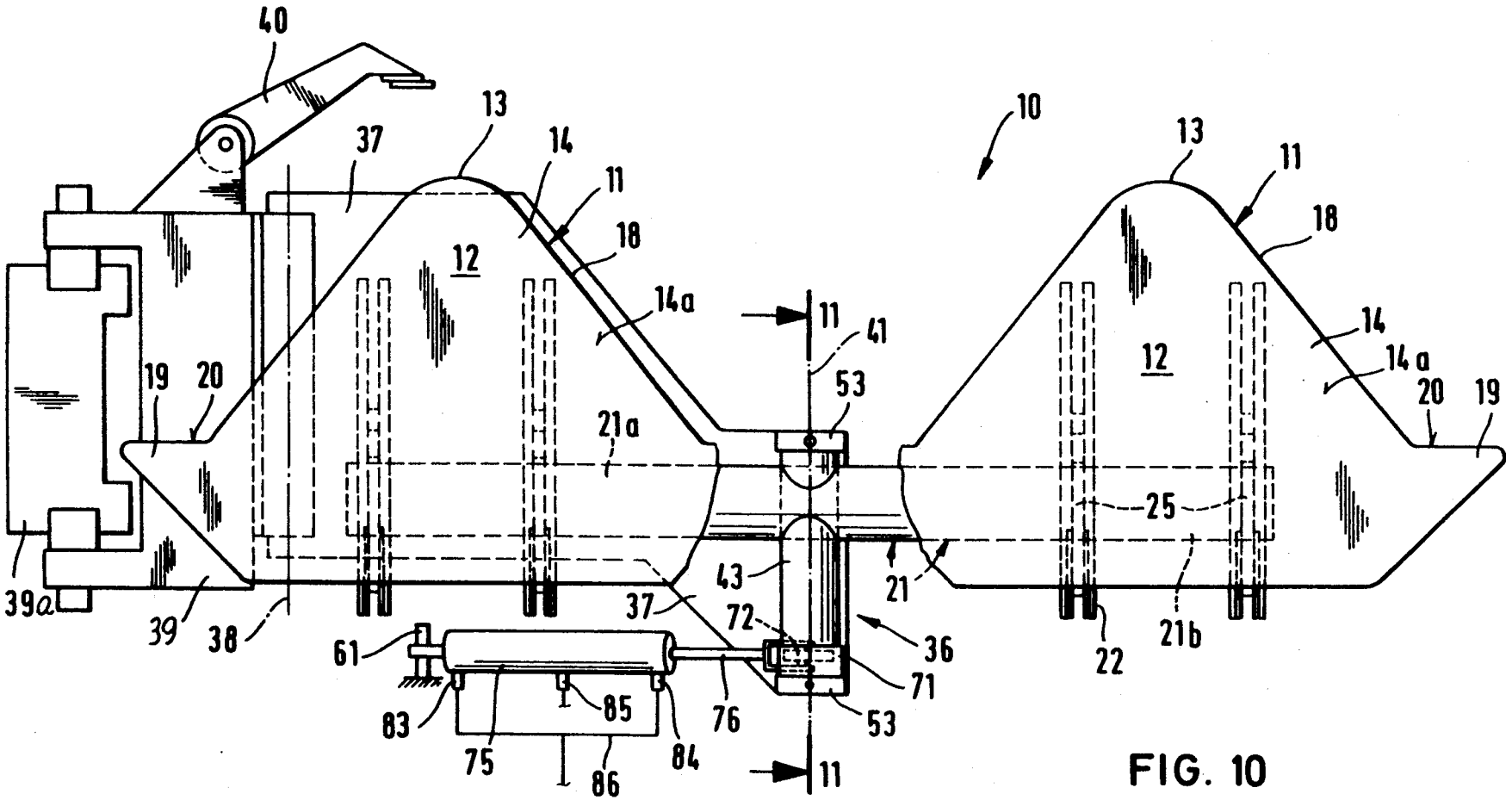
FIG. 10 is a rear elevational view of a modified form of the takeup device in a representation analogous to FIG. 6.

In the modification shown in FIG. 6, in practice, operating members similar to those indicated by the numerals 39*b* and 39*c* in FIG. 3 are provided, in order to achieve the lifting/tilting function described in connection with the embodiment of FIG. 3. The same is true of the embodiments illustrated in FIGS. 7 and 10. The members 39*b* and 39*c* have been omitted from these figures, for clarity.

Figure 5:
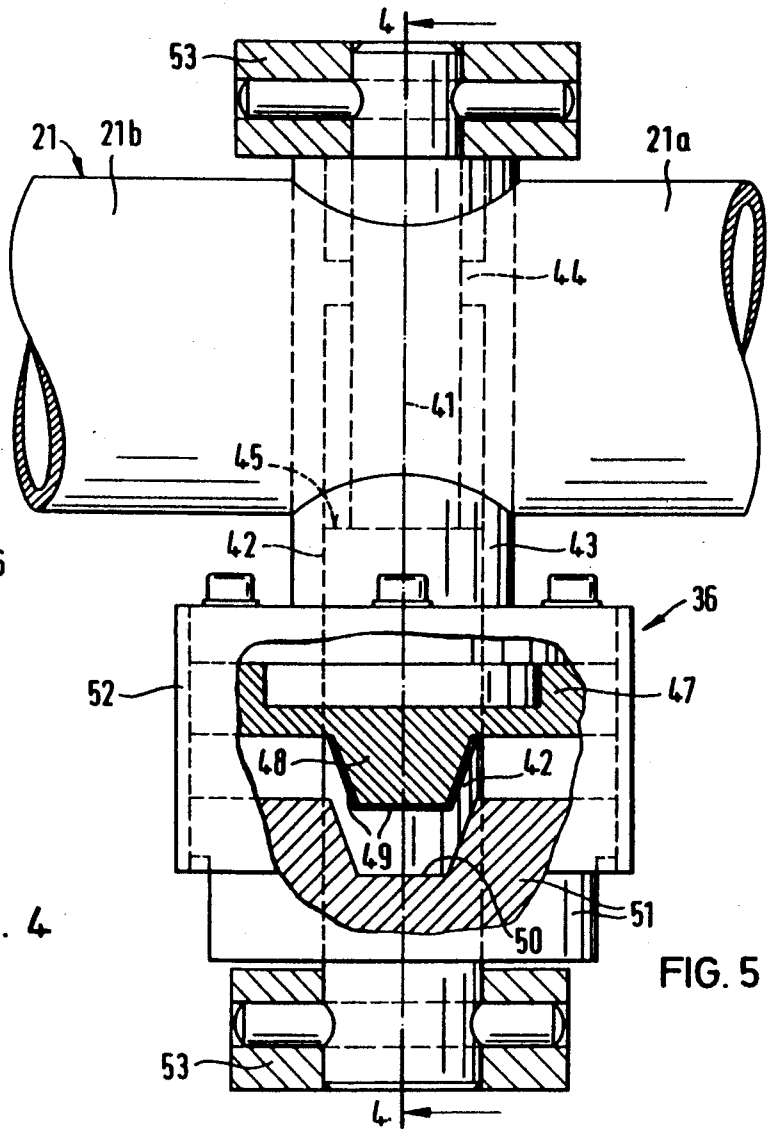
FIG. 5 is a fragmentary section of a portion of the bracket of FIG. 4, taken in a sectional plane rotated 90°.
Figure 6:
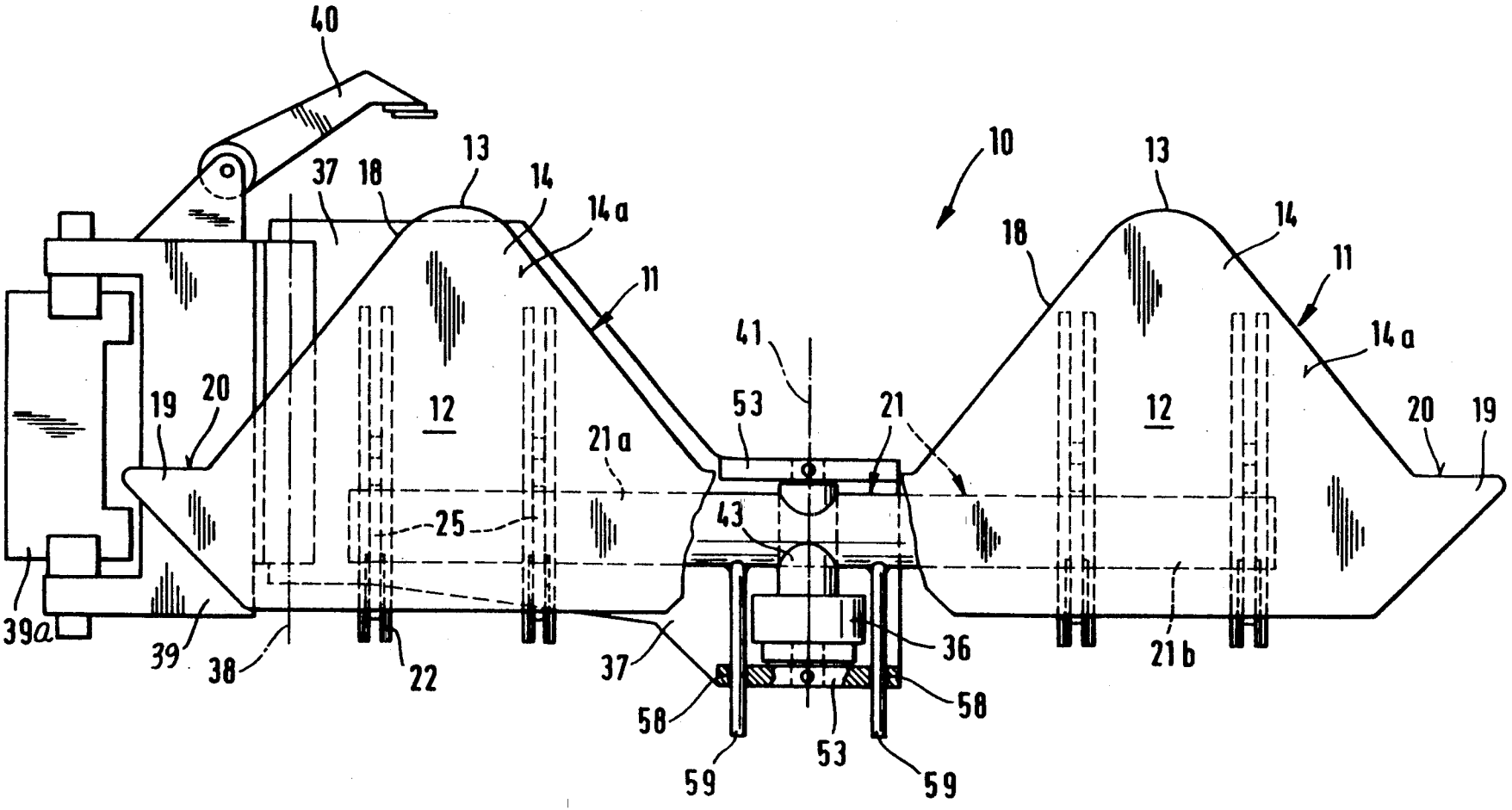
FIG. 6 is a rear elevational view of a somewhat modified takeup device in a representation analogous to FIG. 3, but showing the gripping and carrying plates partly broken away in the central region.

In FIG. 6, the carrying straps 53 on the lifting arm 37 are a little wider than in the example of FIG. 3. The lower carrying strap 53 has on either side of the bracket 36 a bore 58 through which a spring rod 59 is slipped. The spring rods 59 are fastened at their upper ends to the cross-support parts 21*a* and 21*b*, for example by welding. As soon as the cross-support parts 21*a* and 21*b* pivot about the axis 41, the spring rods 59 respond accordingly. In this manner the spring rods 59 always strive to move the cross-support parts 21*a* and 21*b*, i.e. the two-armed cross-support with the gripping and carrying plates 12 applied thereon, back into the center position, which corresponds to the normal starting position for dumping. The return pivotal movement of the cross-support with the gripping and carrying plates 12 takes place as soon as the bin that has been taken up by one or the other carrying plate 12 or by both carrying plates 12, has been raised off the ground. The spring rods 59 are appropriately selected as to their spring force in such a way that while they permit the adjustment of the gripping and carrying plates 12 at the bin to be raised, they develop on the other hand sufficient spring force to hold the bin or bins picked up from the ground in an established normal starting position for dumping. In addition, there can be provided on the bracket 36 a blocking means as described in the following with references to FIGS. 4, 5 or 8, 9.

Figure 4:
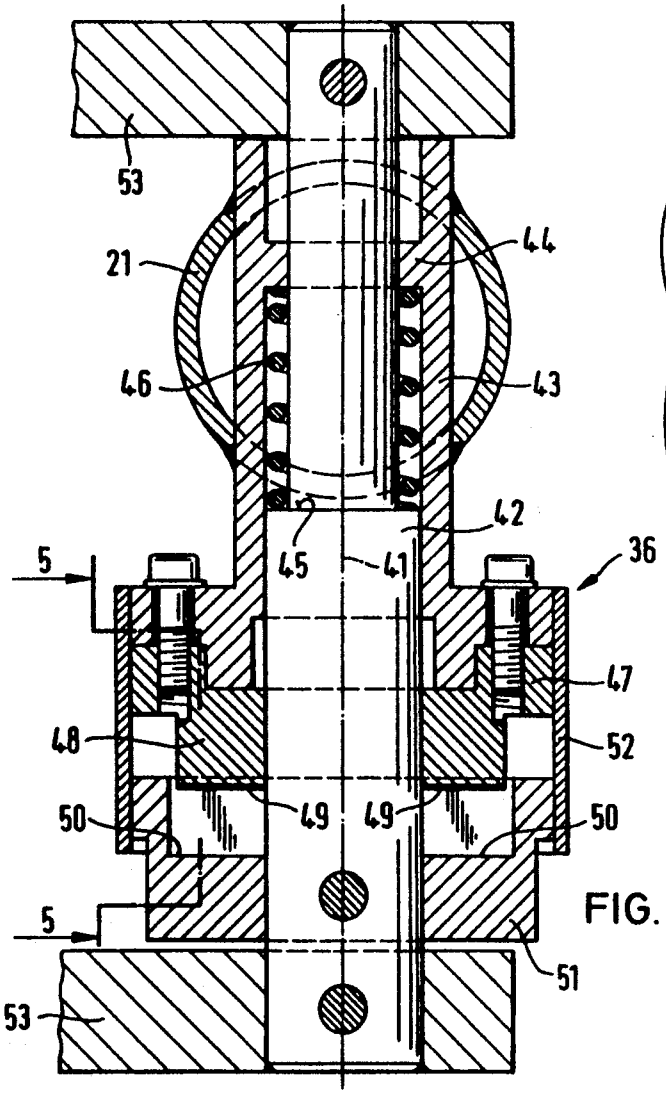
FIG. 4 is a view of the central bracket of a takeup device according to FIG. 3, taken in section along the line 4—4 of FIG. 3.

As FIGS. 4 and 5 show, the bracket 36 comprises a bearing and guiding pin or journal 42 disposed coaxially to the axis 41, which journal is firmly connected with the lifting arm 37 at its upper and lower ends by a carrying strip 53 (see FIG. 3). Disposed on the upper part of the journal 42 is a support bushing 43 which is fastened to the cross-support 21. Inserted between an inner collar 44 of the bushing 43 and a shoulder 45 of the journal 42 is a support spring 46 in the form of a helical compression spring which in the unloaded state of the takeup device 10 holds the bushing 43, the cross-support 21 and the gripping and carrying plates 12 in an upper position. Fitted to the underside of the bushing 43 is an aligning plate 47 with a downwardly protruding aligning strip 48. As FIG. 5 shows, this aligning strip 48 has a trapezoidal cross-section and may be provided with a hard-metal facing 49. Spaced below the aligning plate 47 is a counter-plate 51 fixed on the journal 42. The counter-plate 51 has a diametrical takeup groove 50 which, as FIG. 5 shows, has the same profile as the aligning strip 48. The spacing between the aligning plate 47 and the counter-plate 51 can be somewhat smaller than the height of the aligning strip 48, so that even in the highest position of the support bushing 43 the aligning strip 48 still protrudes a little into the aligning groove 50 and thereby limits the range of rotation of the support bushing 43 on the journal. As soon as the takeup device 10 has a load to transmit from a received bin to the lifting arm 37 via the cross-support 21, the bracket 36 and the strips 53, the support bushing 43 descends counter to the force of the spring 46 axially on the journal 42. As a result, the aligning strip 48 enters into the aligning groove 50 of the counter-plate 51, with the inclined surfaces of the aligning strip 48 and aligning groove 50 sliding partially along one another and, as the two profiles match, they guide the support bushing 43 with the cross-support 21 into a normal position in which the cross-support 21 is retained against any rotation relative to the lifting arm 37. For better guiding of the aligning plate 47 on the counter-plate 51 and to protect the aligning strip 48 and the aligning groove 50 from dirt, a covering and guiding sleeve 52 can be applied on the support bushing 43 and on the aligning plate 47.

Figure 7:
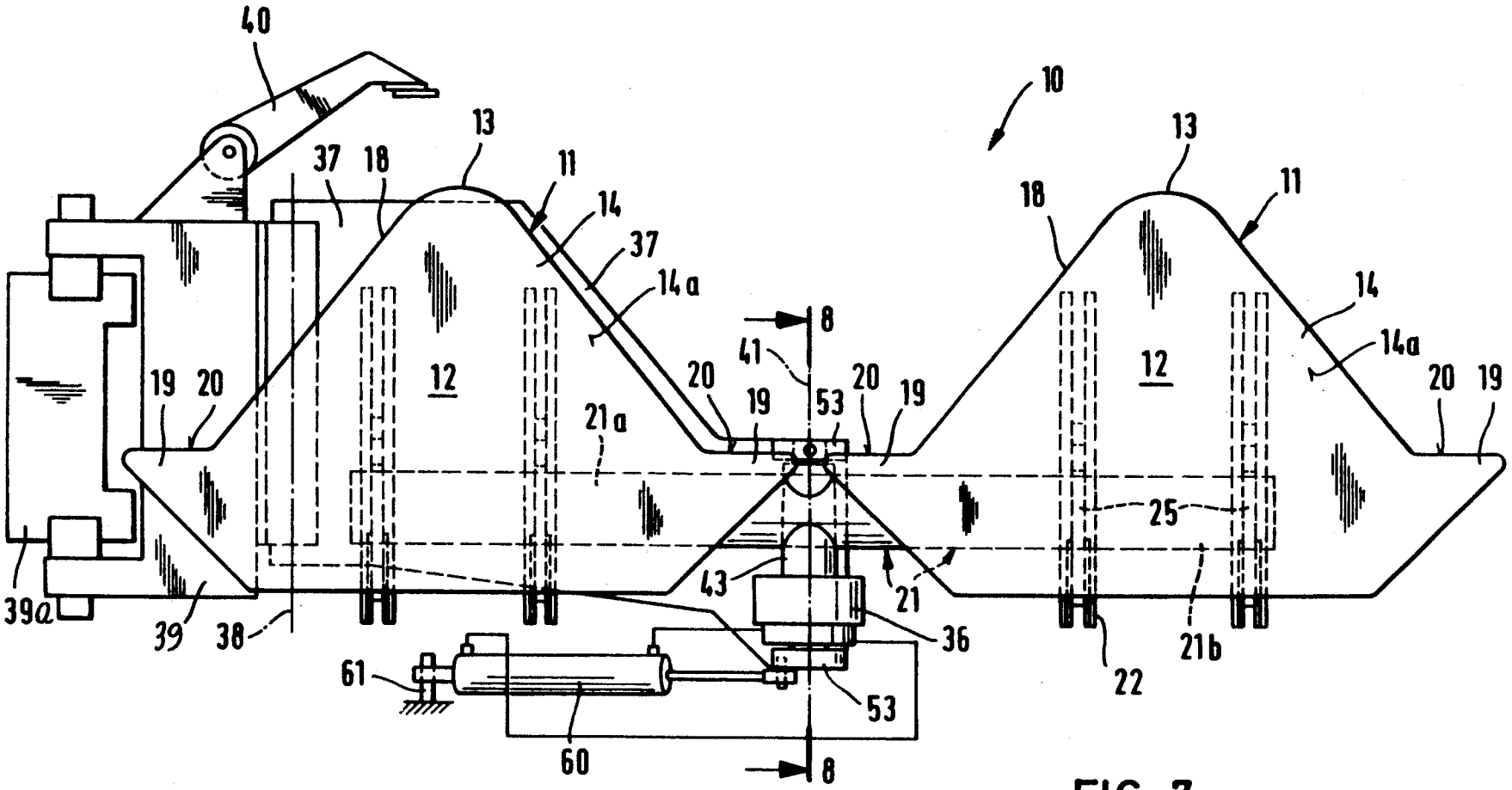
FIG. 7 is a rear elevational view of a further somewhat modified form of the takeup device, analogous to the representation of FIG. 3.
Figure 9:
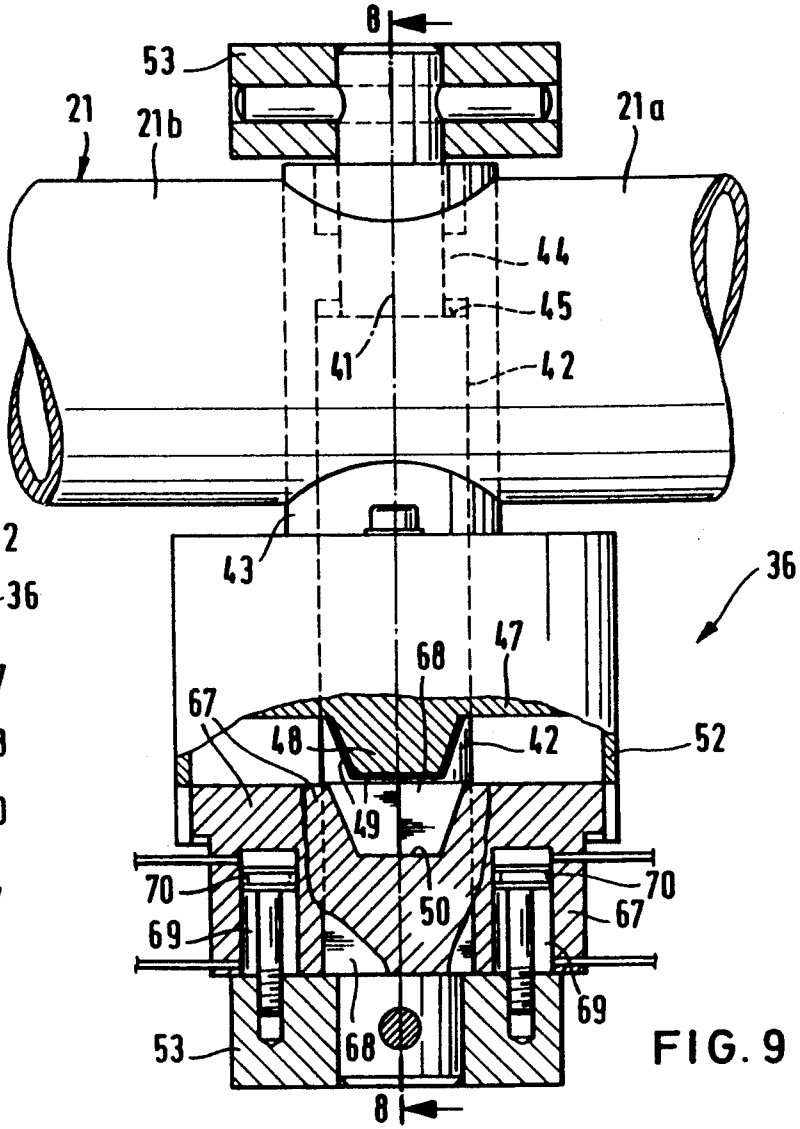
FIG. 9 is a fragmentary section of a portion of the central bracket of FIG. 8, taken in a plane rotated 90°.
Figure 8:
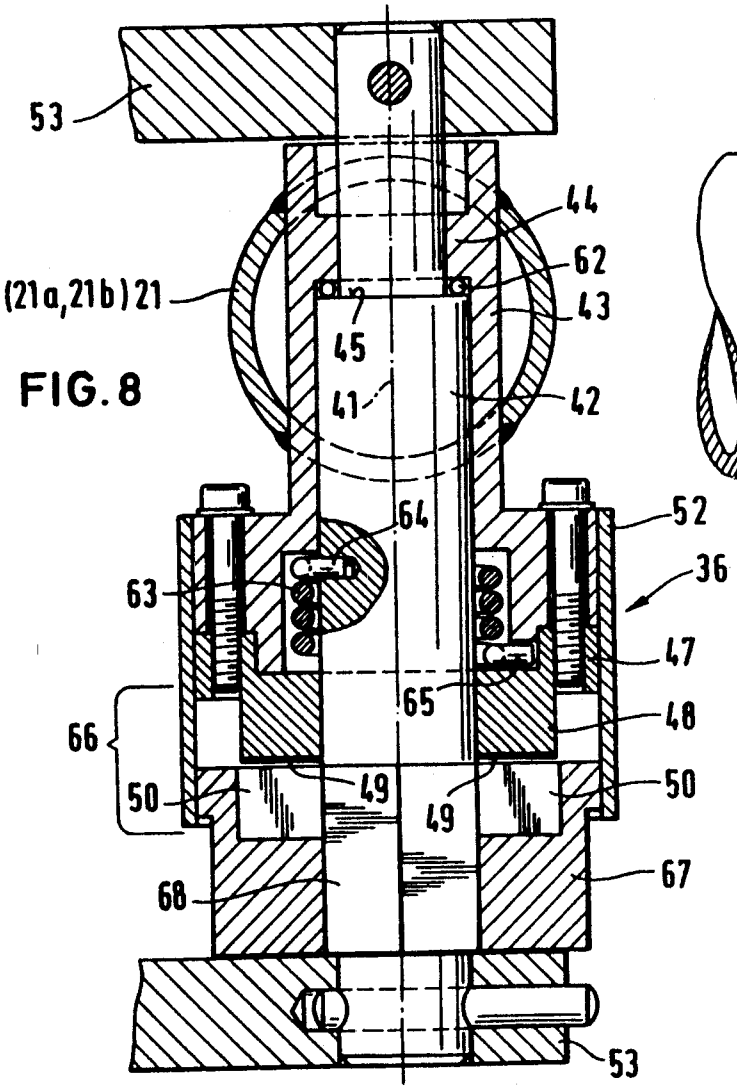
FIG. 8 is a section of a further form of the central bracket of the takeup device, analogous to the representation of FIG. 4.

Another possible construction of the bracket 36 carrying the two-armed cross-support 21*a*, 21*b* is illustrated in FIGS. 7 to 9. According to FIG. 7, the lifting arm 37, carried on the pivot arm 39 for pivoting about the vertical axis 38, is pivotably connected at the underside of the lower carrying strap 53 to a hydraulic piston/cylinder 60 which, at its other end is pivotally articulated to a vertical axis or shaft 612. The vertical shaft 61 is spaced from the vertical axis 38, so that with the pivoting of the lifting arm 37 the hydraulic piston/cylinder 60 is actuated, and in so doing supplies hydraulic pressure medium for the control of the blocking device provided in the bracket 36, which will be explained below with reference to FIGS. 8 and 9. The mutual matching of the hydraulic piston/cylinder 60 to the blocking device is so made that, in the position where the lifting arm 37 is pivoted all the way outward or flapped away, the blocking device is completely disengaged. The blocking device is increasingly engaged and hence the leeway of the cross-support 21*a*, 21*b* is increasingly reduce, the farther that the lifting arm 37 is swung inward, or folded. In the fully folded state, that is, in the normal starting position of the lifting arm 37 for dumping, the blocking device is completely engaged, so that the cross-support 21*a*, 21*b* is also blocked in its normal starting position for dumping.

In the example of FIGS, 8 and 9, the construction of the bracket 36 differs from that according to FIGS. 4 and 5 in that the axial displacement of the bracket body between the carrying straps 53 along the bearing and guiding pins 42 is no longer provided for. Instead, the support bushing 43, to which the cross-support 21 is fastened, is seated by its inner collar 44 on an axial bearing 62 which rests on a shoulder 45 of the bearing and guiding pin 42. In its lower part, the support bushing 43 receives within an annular cutout, a helical torsion spring 63, which engages at its one end 64 the bearing and guiding pin 42, and at its other end 65 the support bushing 43. Instead of one torsion spring 63, two or more torsion springs can be provided. By a rotational movement of the bushing 43 or a pivoting movement of the cross-support 21 about the axis 41 the torsion spring 63 is tensioned. Thereby the torsion spring 63 always strives to bring the bushing 43 and hence the cross-support 21 back to the central position, which corresponds to the established normal starting position for dumping. Lodged in the lower part of the bracket 36 is the blocking device 66, which in this example comprises a blocking plate 67 axially displaceable at the bearing and guiding pin 42 but secured against rotation. To this end the bearing and guiding pin 42 is formed at its lower part with a guiding square 68. Like the articulated plate 51 of FIG. 4, the blocking plate 67 has on its upper side an aligning groove 50. Connected with the lower end of the bushing 43 is, as in the example of FIG. 4, an aligning plate 47 with an aligning strip 48. The mutual positions of the aligning strip 48 and the aligning groove 50 are the same as explained above in connection with FIG. 4.

As FIG. 9 shows, the blocking plate 67 has two cylindrical bores 69, in each of which a control piston 70 is guided. The control pistons 70 are secured by their piston rods to the lower carrying strap 53. If the upper part, the part of the cylinder bores 69 located above the respective control piston, is charged with a hydraulic pressure medium by the hydraulic piston/cylinder, then the blocking plate 67 is pushed upward on the guide square 68 of the bearing and guiding pin 42, depending on the amount of pressure medium supplied. As the aligning strip 48 and the aligning groove 50 have a mutually corresponding trapezoidal cross-section, the freedom of movement of the aligning strip 48 inside the aligning groove is reduced with the upward movement of the blocking plate 67, until the blocking plate 67 reaches the underside of the aligning plate 47 and thus completely blocks the aligning strip 48 in the aligning groove 50. If upon outward pivoting of the lifting arm (FIG. 7) the hydraulic piston/cylinder 60 is actuated in the opposite direction, then the pressure medium is drawn from above the control pistons 70 out of the cylinder bores 69 and is introduced into the space below the control pistons 70. Thereby the blocking plate 67 is lowered onto the carrying strap 53, releasing the aligning strip 48 from the aligning groove 50, so that limitation of movement of the cross-support 21 relative to the carrying straps 53 or relative to the bearing and guiding pin exists essentially now only due to the torsion spring 63. The gripping and carrying plates 12 can now again be applied, counter to the action of the torsion spring 63, against one or two bins to be taken up, and after the bin or bins have been lifted, the torsion spring again performs a first erecting of the cross-support 21 and of the received bins relative to the lifting arm 37 and, upon folding of the lifting arm 37 into the normal starting position for dumping, the above described blocking process occurs with a fixation of the cross-support 21, of the gripping and carrying plates 12, and of the received bin or bins in the normal starting position for dumping.

As indicated in FIG. 2 schematically in dashed lines, the convexly arched gripping surface 17 of the gripping and carrying plate 12 forms together with the wall of the uptake pocket 54 on the bin 55 a guiding and centering means for the bin 55 relative to the uptake claw 11. Upon introduction of the gripping and carrying plate 12 into the uptake pocket 54, the bottom edge of the pocket wall 56 lying spaced from the bin wall slides over the concavely arched gripping surface 17 and in so doing aligns the uptake pocket 54 relative to plate 12 and hence the bin 55 to be emptied relative to the takeup claw 11. As can further be seen from FIG. 2, in the illustrated example, with the takeup claw fully introduced into the uptake pocket 54, the lower edge of the pocket wall 56 still remains on the gripping surface 17, so that the centering action persists even after the bin 55 has been lifted.

As is indicated in broken lines in FIG. 3, the pocket wall 56 spaced from the wall of the bin 55 can be provided with a lower arcuate or triangular cutout 57, so that the bottom edge of the pocket wall 56 extends by a certain amount around the arch of the gripping surface 17, thereby increasing the centering action.

In any case, by the cooperation of the arched gripping surface 17 with the pocket wall 56, in particular the bottom edge thereof, the snug contact of the bin wall on the abutment surface 14*a* of the gripping and carrying plate 12 is assured.

Figure 11:
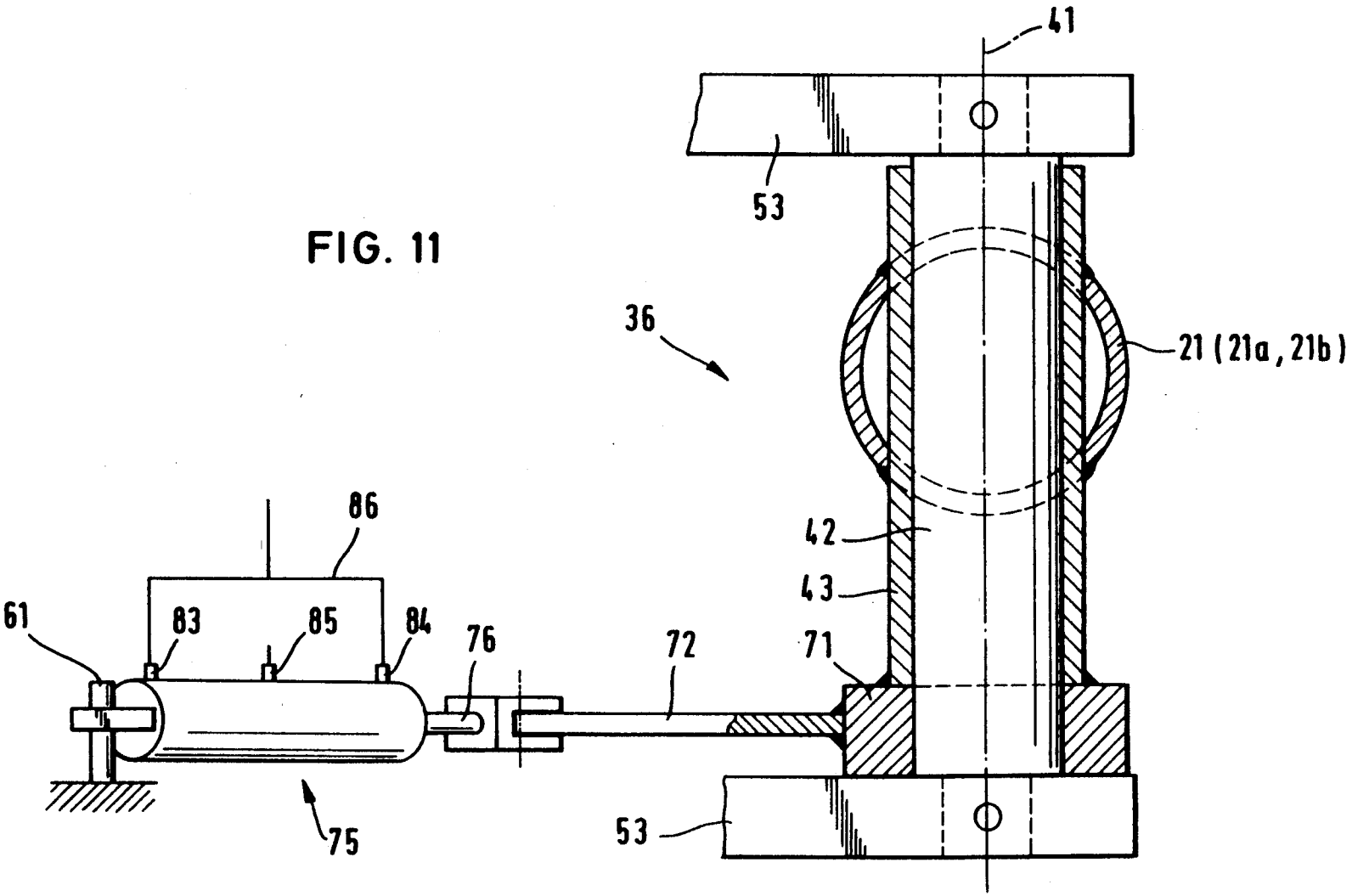
FIG. 11 is an axial section through the bracket, taken along the line 11—11 of FIG. 10.

In the example of FIGS. 10 to 14, the takeup device is again provided with a two-armed cross-support 21*a*, 21*b* which carries a gripping and carrying plate 12 on each lever arm. The cross-support 21*a*, 21*b* is secured on a bracket 36 which is limitedly rotatable about the axis 41. As FIG. 11 shows, the bracket 36 is again rotatably mounted by means of a journal 42 on both carrying straps 53 of the lifting arm 37. The bushing 43 of the bracket 36 is secured in this example on a support plate 71 which is mounted on the journal 42 and rotatable about the axis 41, and which comprises a pivot lever 72 constituted as a projection on which the piston rod 76 of the hydraulic setting and blocking cylinder 75 is pivotable. The second end of the hydraulic setting and blocking cylinder 75 is articulated to the apparatus frame, to pivot about a vertical axis.

Figure 13:
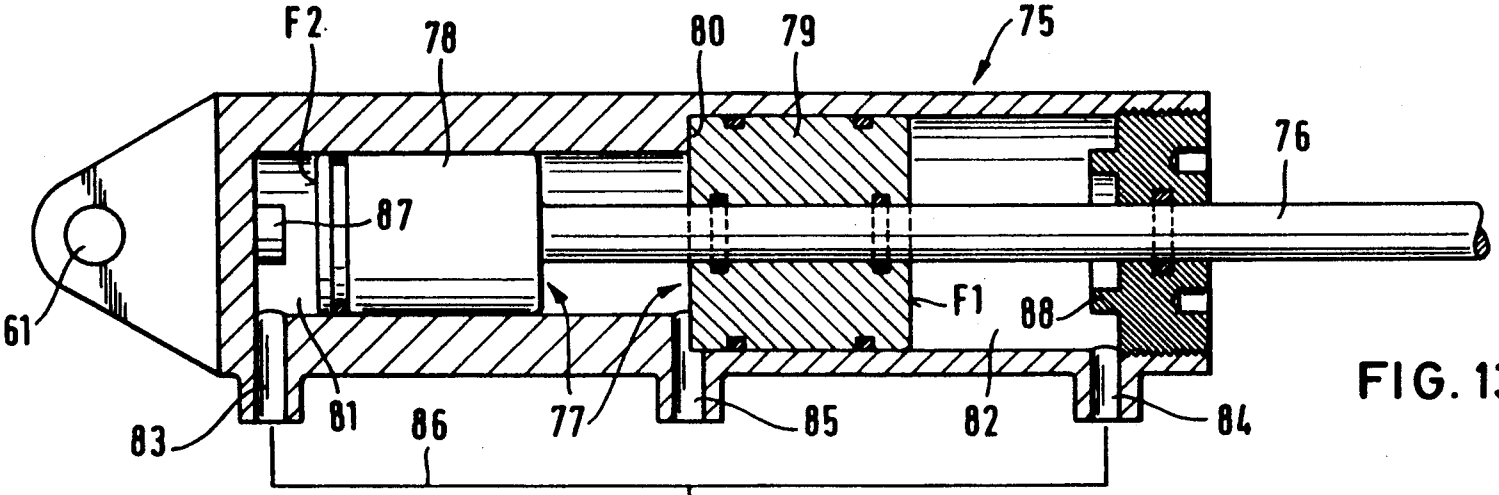
FIG. 13 is an enlarged schematic representation of the piston position in the setting and blocking cylinder with adjustment, of the takeup device in the sense of the arrows 73 in FIG. 12.
Figure 14:
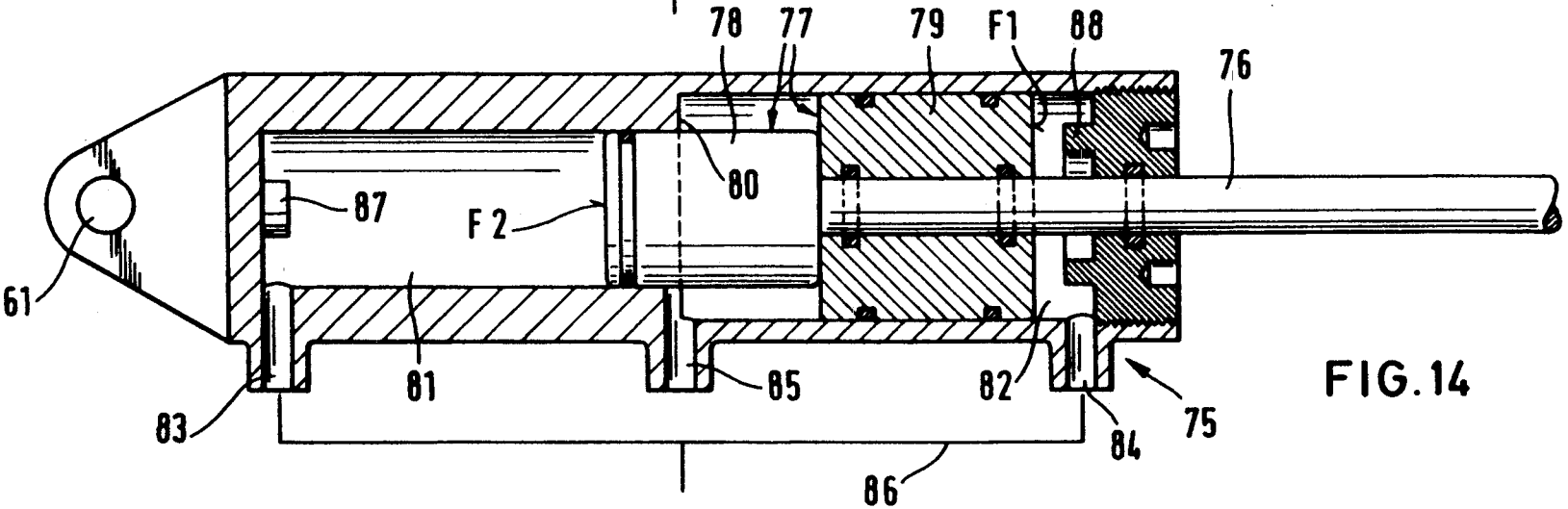
FIG. 14 is an enlarged schematic representation of the piston position in the setting and blocking cylinder with adjustment, of the takeup device in the sense of the arrows 74 in FIG. 12.

The setting and blocking cylinder 75 contains a differential double piston 77, formed by a plunger type front piston part 78 firmly connected with the piston rod 76 and a ring piston 79 axially displaceable on the piston rod 76 annularly but sealed behind the piston part 78. Accordingly the interior of the setting and blocking cylinder 75 has two compartments, which are offset from each other by a shoulder 80, namely a narrower compartment 81 in which the plunger type front piston part 78 slides, and a wider compartment 82 in which the annular piston part 79 slides. The compartment 81 in front of the plunger type piston part 78 is provided with a pressure medium connection 83, while the compartment 82 behind the annular piston part 79 is provided with a pressure medium connection 84. In the region of the shoulder 80 there is another pressure medium connection 85. Connections 83 and 84 are interconnected by a pressure medium line 86 and are connected in this parallel arrangement to the pressure medium lines of the hydraulic control and operating system of the apparatus through which the pressure medium motors, of the apparatus intended for the lifting and tilting, are charged with hydraulic pressure medium. The pressure medium inlet 85 near the shoulder 80 is connected to the low-pressure side of the hydraulic control and operating system, for example the pressure medium reservoir, or is open only toward the atmosphere. As FIGS. 13 and 14 show, the annular piston part 79 has toward its pressure medium chamber 82 an end face F1 to be contacted by the pressure medium, and the plunger type piston part 78 toward its chamber 81 has an end face F2 to be contacted by the pressure medium. The face F1 of the annular piston part 79 is considerably larger than the face F2 of the piston part 78, for example twice as large.

The operation of the reset unit provided in the example of FIGS. 10 to 14 is as follows:

With the takeup device 10 lowered, the pressure medium lines leading to the pressure medium motors for lifting and tilting the bin to be emptied are largely pressure-relieved. Therefore the piston parts 78 and 79 can be displaced inside the setting and blocking cylinder 75 with relatively little force; the hydraulic pressure medium present in the compartments 81 and 82 more or less only dampens this displacement movement. On moving the takeup device 10 against a large bin or one or two set-up smaller bins, the cross-support 21*a*, 21*b* with the gripping and carrying plates 12 mounted on it can pivot relative to the bin or bins to be received, by pivoting at the bracket 36 either in the direction of the arrows 73 shown in FIG. 12 or the direction of the arrows 74 shown in FIG. 12, to adapt the positions of the gripping and carrying plates 12 to the walls of the respective bin or bins. If pivoting of the cross-support 21*a*, 21*b* is in the sense of the arrows 73, the piston rod 76 is shifted toward the interior of the setting and blocking cylinder 75, the plunger type front piston part 78 being displaced in its compartment 81 as is shown in FIG. 13. This movement is limited by a limiting stop 87 in the compartment 81, which thereby establishes also the limitation of the possible pivoting movement of the the cross-support 21*a*, 21*b* in the sense of the arrows 73. During this movement the annular piston part 79 stays at the shoulder 80. If starting from a piston position according to FIG. 13 the hydraulic control and operating system of the apparatus is actuated for supplying pressure medium to the pressure-medium motors of the apparatus provided for the lifting and tilting of the bins, elevated pressure is again built up in the interior of compartments 81 and 82, namely the same pressure in both compartments. The annular piston part 79 is thereby pushed against the shoulder 80, while the plunger type piston part 78 is from its position shown in FIG. 13 against the annular piston part 79. Thereby the cross-support 21*a* , 21*b* is returned to the normal starting position for dumping. As the face F1 of the annular piston part 79 is much larger than the face F2 of the plunger type piston part 78, the part 78 stays at the part 79 and the latter stays at the shoulder 80. The reset unit is thus blocked in this piston position and thus holds the takeup device blocked in the normal starting position for dumping.

Figure 12:
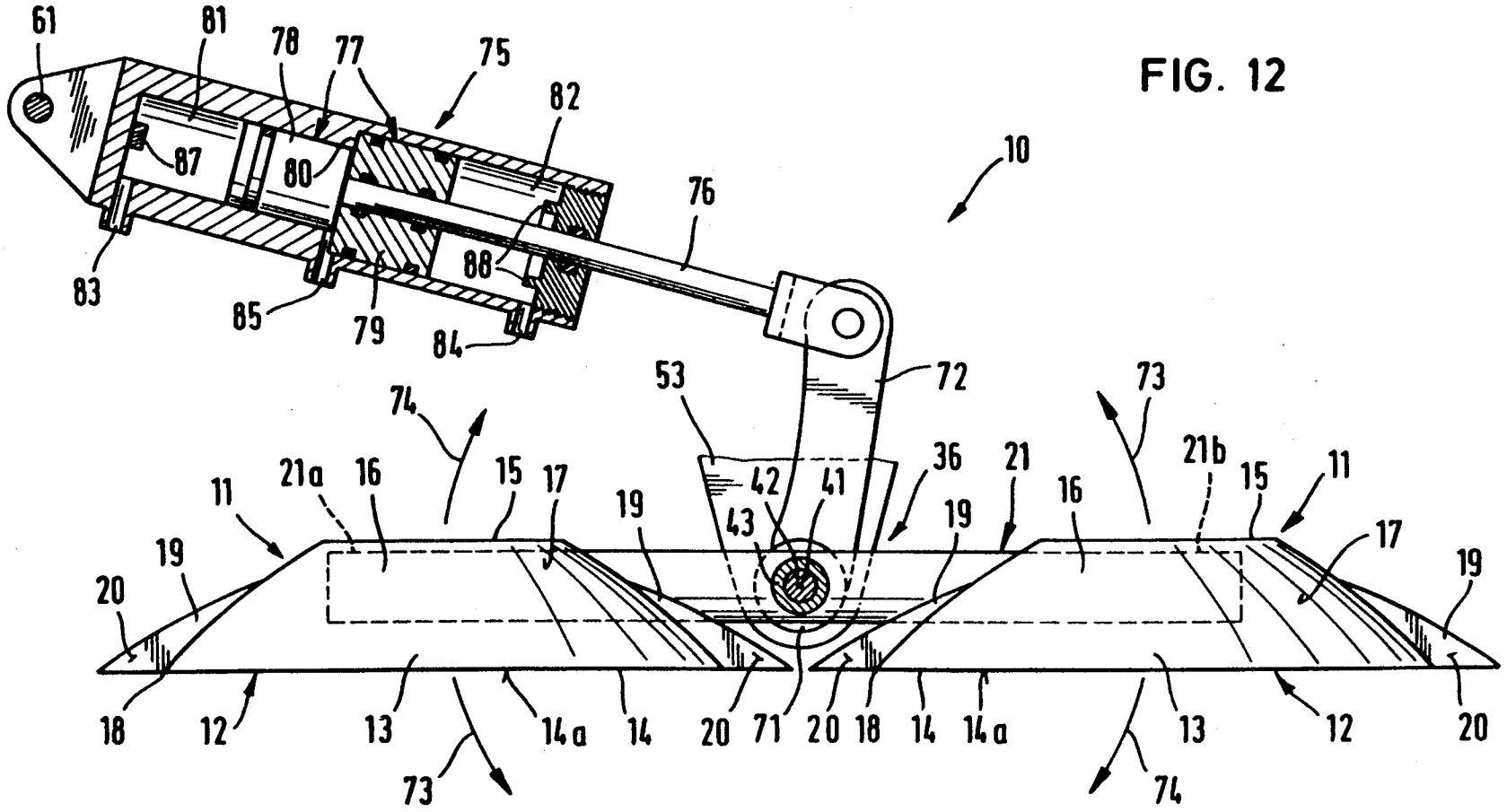
FIG. 12 is a schematic top view of the takeup device of FIG. 10, with a schematic sectional representation of the hydraulic setting and blocking system.

If the cross-support 21 is pivoted in the sense of the arrows 74 in FIG. 12 as the gripping and carrying plates 12 approach a bin or two bins to be emptied, the piston rod 76 is extracted from the cylinder 75. The plunger type piston part 78 then pushes the annular piston part 79 ahead of itself until the gripping and carrying plates 12 have adapted themselves to the bin or bins to be emptied or until the annular piston part 79 strikes against a stop 88 inside the setting and blocking cylinder 75. The stop 87 limits the pivoting of the cross-support 21*a*, 21*b* in the direction of the arrows 74. If starting from the piston position of FIG. 14 the hydraulic control and operating system of the apparatus for lifting and tilting a bin to be emptied is set in operation to supply the respective pressure-medium motors with hydraulic pressure medium, then elevated but equal pressures are built up simultaneously in the compartments 81 and 82 of the setting and blocking cylinder 75. As the face F1 of the annular piston part 79 is much larger than the face F2 of the plunger type piston part 78, both piston parts 78 and 79 are pushed, with displacement of the pressure medium contained in the compartment 81, into a position in which the annular piston part 79 strikes against the shoulder 80. Through the pressure of the hydraulic pressure medium prevailing in the compartment 81, the plunger type piston part 78 is pushed against the annular piston part 79 but cannot move the latter away from the abutment on the shoulder 80. Hence, starting from the piston position of FIG. 14, there occurs a resetting and pivoting back of the cross-support 21*a*, 21*b* into the normal starting position for dumping, and a blocking in the normal starting position.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. In a lifting and tilting apparatus for emptying garbage bins (55) having uptake pockets (54) into the opening of a collecting bin, said apparatus having gripper means (12) adapted to be received in said uptake pockets (54) of said garbage bins (55), and said apparatus further having a cross beam (21) and a lifting arm (37), and means (39*a*, 39*b*, 39*c*) for causing up and down arcuate movement of the lifting arm (37) about a horizontal axis, characterized in that:

the said cross beam (21) has a pivot joint (36) connected thereto, said cross beam further having a pair of arms (21*a*, 21*b*) extending in opposite directions from said pivot joint (36), said pivot joint being connected to said lifting arm (37) for swivelling movement of the cross beam (21) with respect to the lifting arm (37) about an upright axis, and further characterized by said gripper means comprising two substantially triangular gripping and carrying plates (12, 12) one on each arm (21*a*, 21*b*) of the cross beam (21), said apparatus being further characterized by a mechanism (75, 76) connected with the pivot joint (36) for swinging the cross beam (21) with respect to the lifting arm (37).

2. A lifting and tilting apparatus according to claim 1, characterized in that:

the said mechanism (75, 76) comprises a fluid-actuated piston and cylinder means mounted to pivot about a vertical axis (61), and a lever (72) operated by said piston and cylinder means and connected with said cross beam at said pivot joint (36).

3. Apparatus for emptying containers (55) into the openings of a collecting bin, comprising, in combination:

a) a lifting arm (37), and means (39*a*, 39*b*, 39*c*) for causing up and down movement of the lifting arm, b) a cross beam (21), c) means (36) pivotally mounting said cross beam on said lifting arm for swivelling movement about an upright axis and means for causing said swivelling movement, d) gripper and carrying means comprising a substantially triangular gripping and carrying plate (12), e) linkage means disposed between and movably connecting said gripper and carrying plate (12) and said cross beam (21), and f) cam means including a cam and a cam follower, mounted one on said cross beam (21) and the other on said gripper and carrying plate (12) and operable between said cross beam and gripper and carrying plate, controlling movement of the gripper and carrying plate (12) about a horizontal axis and with respect to the cross beam, within limits.

4. An apparatus as set forth in claim 3, wherein:

a) said gripper and carrying means comprises a second substantially triangular gripping and carrying plate (12) and means movably mounting said second gripper and carrying plate on said cross beam at a location spaced from said first-mentioned gripping and carrying plate (12), b) said pivotal mounting means (36) being located between the said gripper and carrying plates (12, 12) and being spaced therefrom.

5. An apparatus as set forth in claim 4, wherein:

a) said gripper and carrying plates can have limited swivelling movement on said cross beam.

6. An apparatus as set forth in claim 4, wherein:

a) said means which movably mounts the second gripper and carrying plate on the cross beam comprises a linkage.

7. An apparatus as set forth in claim 4, wherein:

a) said gripper and carrying plates can each have limited independent swivelling movement on said cross beam.

* * * * *